US006062849A

United States Patent [19]

Polidoro

[11] Patent Number: 6,062,849

[45] Date of Patent: May 16, 2000

[54] GAS BURNER

[75] Inventor: Aldo Polidoro, Schio, Italy

[73] Assignee: Industrie Polidoro A. S.p.A., Schio, Italy

[21] Appl. No.: 09/131,757

[22] Filed: Aug. 10, 1998

[51] Int. Cl.[7] ..... F23D 14/08; F23D 14/10

[52] U.S. Cl. ..... 431/354; 431/8; 431/114; 431/326; 431/350

[58] Field of Search ..... 431/355, 354, 431/114, 328, 326, 350, 8; 239/593, 590, 560, 566, 568, 553.3, 553, 562

[56] References Cited

U.S. PATENT DOCUMENTS

| | | | |
|---|---|---|---|
| 1,507,791 | 9/1924 | Packer | 431/354 |
| 1,642,426 | 9/1927 | Risinger | 431/286 |
| 2,572,273 | 10/1951 | Miler et al. . | |
| 3,028,909 | 4/1962 | Faure | 431/18 |
| 3,192,989 | 7/1965 | Miller | 239/560 |

FOREIGN PATENT DOCUMENTS

| | | | |
|---|---|---|---|
| 63-201415 | 8/1988 | Japan | 431/328 |

*Primary Examiner*—Carl D. Price
*Attorney, Agent, or Firm*—Bucknam and Archer

[57] ABSTRACT

This invention concerns a combustible gas atmospheric burner of the so-called "small-ramp type", comprising at least a body (1) consisting of two half-shells in a vertical plane of symmetry, configured in the lower part as a venturi tube (4), wherein the mixture of combustible gas and air is introduce by way of a nozzle (18). In its upper part it has a head made of high-temperature resisting material where the combustion takes place. The upper part of the burner body has portions of different cross-section so that the mixture exits from the said head in such a manner that its output is essentially uniform and of a laminar nature along the entire longitudinal dimension, which gives rise to a reduction in the noise emitted by the burner, as compared with similar arrangements of a known type.

6 Claims, 4 Drawing Sheets

FIG. 14
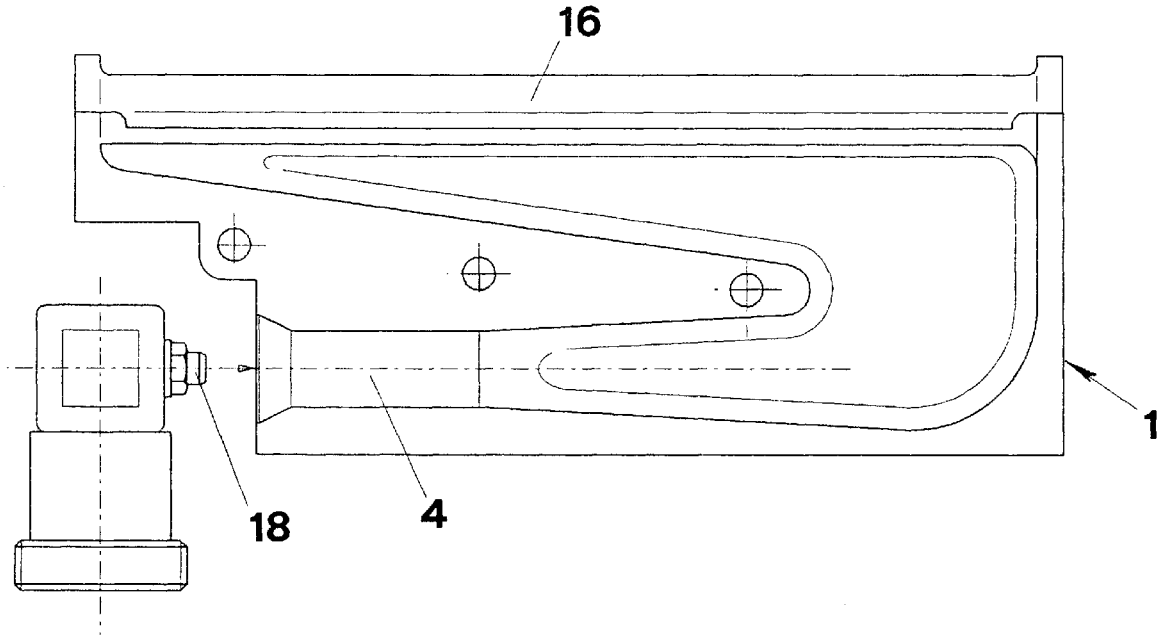
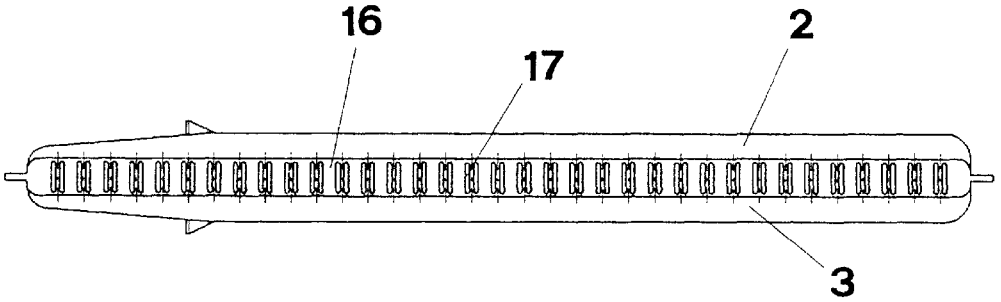
FIG. 15

GAS BURNER

FIELD OF THE INVENTION

This invention relates to combustible gas atmospheric burner of the type deemed as the "small ramp" type.

BACKGROUND OF THE PRIOR ART

The term "small-ramp" burner is intended to indicate a burner fitted with a plurality of similar burners of relatively small dimensions, so that their heads are arranged parallel side by side and suitably spaced.

Each of the heads has one or several rows of outlet holes, from which issues the mixture consisting of combustible gas and combustion air where the flame is developed.

In most cases each "small-ramp" burner has a body consisting of two half-shells with a vertical plane of symmetry, configured in the lower part in the form of a venturi tube, in which the combustible gas and air mixture is emitted by means of a nozzle.

The head with outlet-holes, which is made of high-temperature resisting material, is arranged in an opposing manner in the upper part in relation to the venturi tube.

The burners are normally used in boilers located in central heating installations and to generate hot water. The said burners emit an operating noise which, although not at a particularly high level, nevertheless does not allow the equipment in which they serve to satisfy the strict requirements established in the European Union directives regarding noise emission by domestic heating equipment. The said noisiness measured at approximately 55 dB is essentially due to the turbulence of the combustible gas and air mixture at the exit from the burner head.

The said noisiness manifests itself as a distinct buzz which also proves irritating within a domestic location.

SUMMARY OF THE INVENTION

An object of the present invention is to achieve a "small-ramp" burner having characteristics of a nature avoiding the inconvenience described above, ensuring that the air and combustible gas mixture exits from the burner head in a laminar manner, so that the flame advance front (the so-called "blue cone", source of the noise) is extremely stable and free from turbulence.

According to the invention, this is obtained by ensuring that the upper part of the body of the burner is configured in such a manner that its transverse sections vary in relation to the existing pressure in the part immediately upstream from the said pressure, so as to achieve an essentially constant mixture capacity along the entire dimension of the burner head.

In particular the section through the burner will be greater where the pressure is low, whereas it will be smaller in the case of higher pressure values.

In practice the extension of the said section assumes a decreasing function of the pressure existing within the burner body.

BRIEF DESCRIPTION OF THE DRAWINGS

One embodiment of burner will now be described in detail, with reference to a particular form of implementation, given as a non-restrictive example, and referring to the appended drawings, wherein:

FIG. 14 represents a complete side-view of the burner.

FIG. 15 represents a complete plan view of the burner.

In FIGS. 1 and 2 it will be seen that the burner according to the preferred form of the invention of the so-called "small-ramp" type, comprises a body 1 formed by two half-shells 2 and 3, with a vertical plane of symmetry and configured in the lower part as a venturi tube 4, in which the air and combustible gas mixture is introduced by means of a nozzle 18, illustrated in FIG. 14.

In the upper part of the burner there is a head 16 (which is not illustrated in FIGS. 1 and 2, but appears in FIGS. 9, 10 and 14, 15) which has at least a row of outlet-holes 17, arranged in reciprocal parallel mode and where the combustion takes place. This entire structure is achieved with known characteristics.

Figure 7:
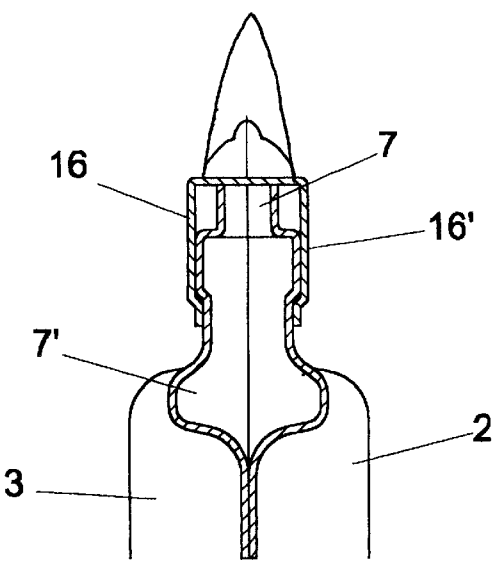
In FIGS. 5, 6 and 7 three vertical sections of the burner are illustrated, viewed respectively along lines V—V, VI—VI and VII—VII of FIG. 1.
Figure 6:
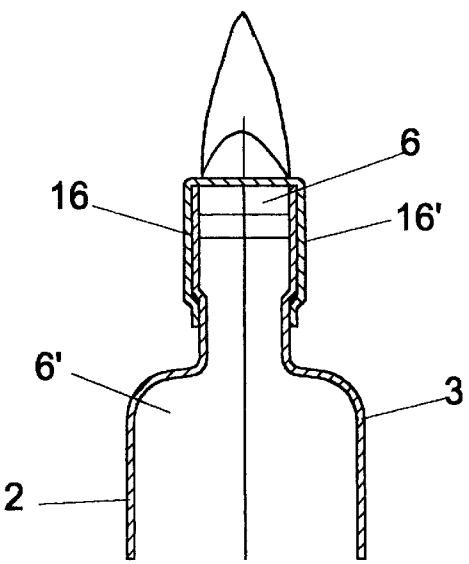
Figure 5:
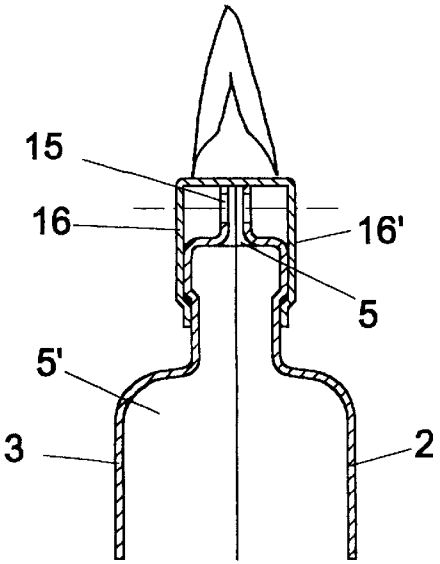
Figure 8:
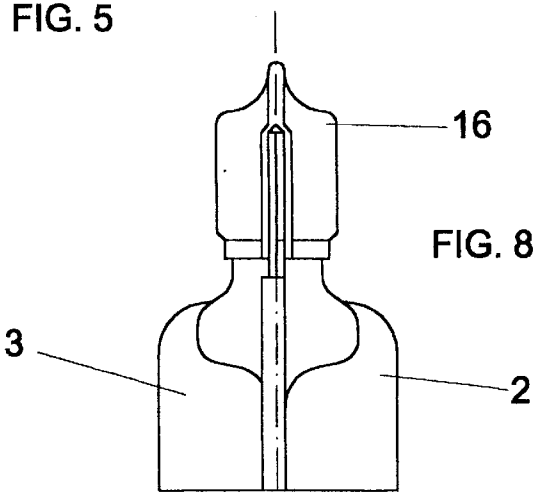
FIG. 8 represents a front view of the burner.
Figure 10:
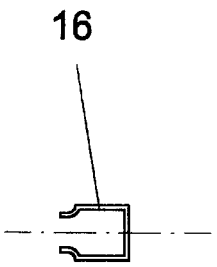
FIGS. 9 and 10 respectively represent a plan view and a side view of the burner head.
Figure 9:
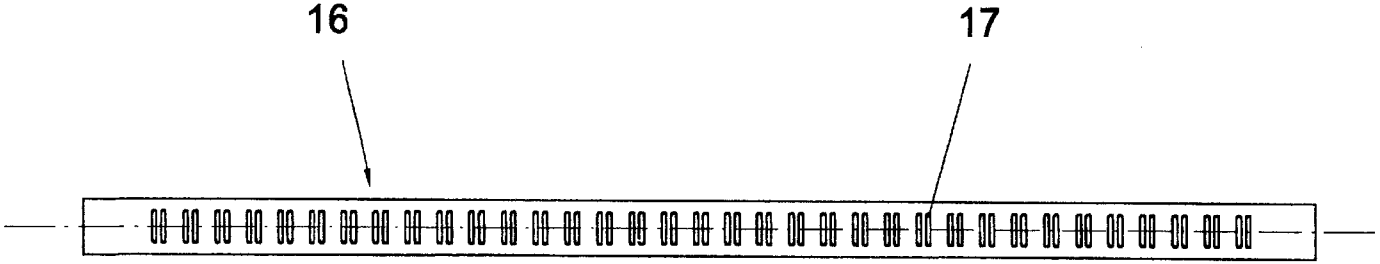
Figure 13:
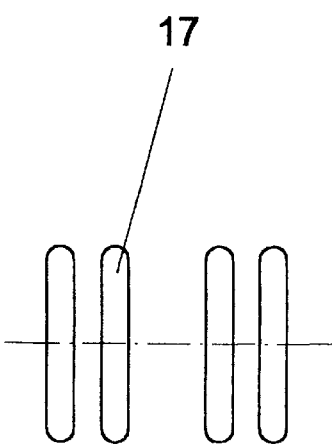
FIGS. 11 to 13 each represent a particular arrangement of the outlet-holes in the burner head.

A basic characteristic of the arrangement according to the invention lies in the fact that as illustrated in FIGS. 5, 6 and 7, the upper part of the burner body has exit sections for the mixture (references 5, 6 and 7) which can vary in relation to the pressure existing in the area located upstream (references 5', 6', 7') inside the burner itself.

Figure 1:
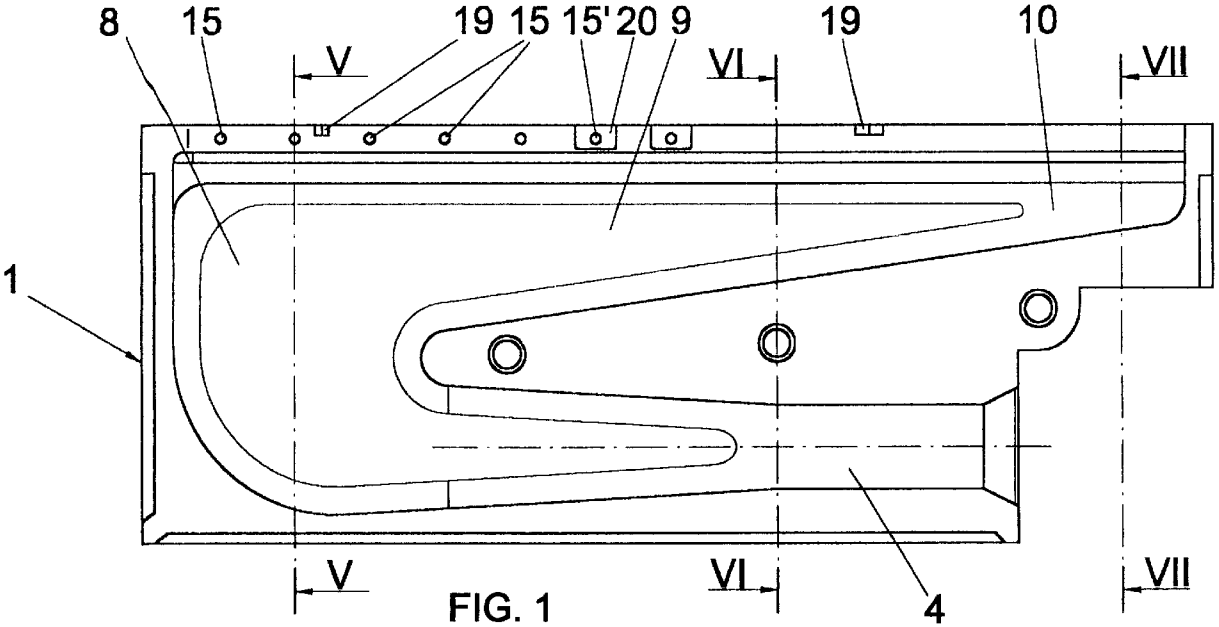
FIGS. 1 and 2 respectively represent a lateral view and a plan view, suitably in section of the burner without the head.

In particular, referring to FIG. 1 in the area bearing reference 8, located immediately downstream from the venturi tube 4, a high pressure prevails and consequently the section 5 of the upper part of the burner body (FIG. 5) is much restricted.

As opposed to this, in the central zone 9 of the burner, there is in opposition a relatively low pressure and consequently the upper part of the burner has a somewhat large cross-section 6 (FIG. 6).

Finally in the end zone 10 of the burner, where a relatively high "static" pressure prevails, there is a form of section 7 restricted relative to that of the central part 9 of the burner, although not as restricted as in the initial part 8 of the burner.

Thanks to these measures and the particular shape of the distribution outlet-holes, the air and combustible gas mixture exits from the burner head uniformly along the entire longitudinal length and in a laminar form, which gives rise to a particularly silent flame.

As may be seen in FIGS. 5–7, the mixture is made to exit between two parallel walls of suitable height and perfectly smooth, without the projections as suggested before by the prior state of the art.

Figure 12:
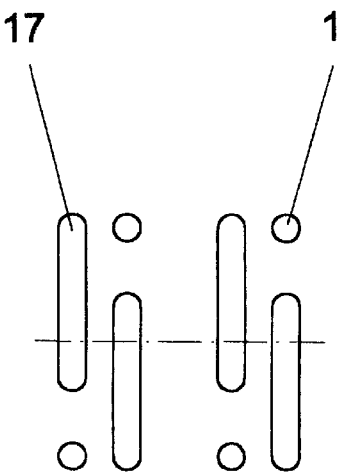
Figure 11:
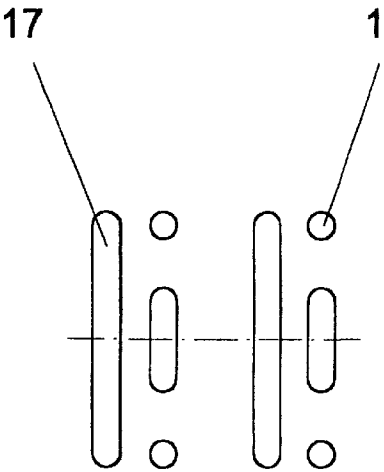

The reduction in noise emitted by the burner compared with that encountered in similar designs of known type, is equal to some dB's. As may be seen in FIGS. 11 and 12, the outlet-holes 17 located in the burner head, may be accompanied by holes 14 for the pilot flame to ensure the stability of the flame even under the high pressures at the nozzle 18.

In order to facilitate the supply to the said holes for the pilot-flame, a plurality of holes 15 is advantageously provided in the upper part of the burner half-shells 2 and 3, the said holes being located at the upper end of the burner body.

Figure 3:
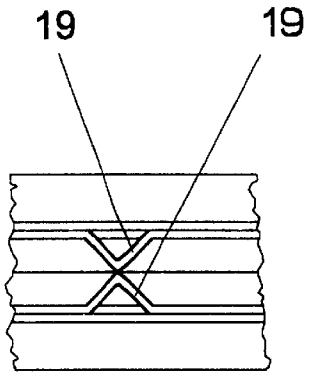
In FIGS. 3 and 4 two components of the burner model are shown, as located in circles III and IV of FIG. 2.
Figure 4:
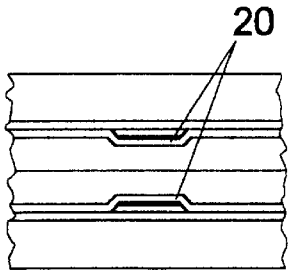
Figure 2:
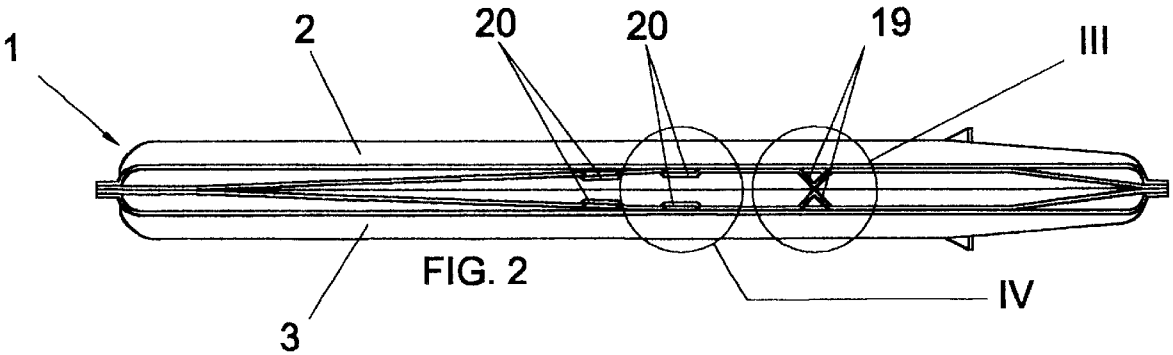

As may be seen in FIGS. 2 and 3 on the inner flanks of the two half-shells 2 and 3, at least two projections 19 are provided reciprocally facing each other, presenting a minimum resistance to the passage of the gaseous mixture and obtained by shearing as opposed to pressing; these have the purpose of maintaining the constant reciprocal distance between the two half-shells 2 and 3. In FIGS. 1, 2 and 4 it will be seen that on the inner flanks of the two half-shells 2 and 3 there are indentations 20 complete with holes 15' (FIG. 1) to establish further pilot-flames on the burner head.

I claim:

1. A combustible gas atmospheric burner of the "small-ramp" type, comprising a body (1) and a head (16), said body consisting of two half-shells (2)(3), said half-shells being arranged faced to each other, said body (1) having a lower part (8), an intermediate part (9), and an upper part (10), said lower part being configured as a venturi tube (4), the air/combustible gas mixture being introduced into said venturi by way of a nozzle (18), said head (16) being made of high temperature resisting material and being located in said upper part of said body, at least one row of reciprocally parallel outlet-holes (17) where the combustion takes place being located on said head (16), wherein the upper part of said body (1) has portions (5,6,7) of cross-section different from one another with relation to the pressure existing beneath said sections, portion (8) of said upper part of the burner body located downstream of said venturi having high pressure and a most restricted section portion (9) intermediate its length having low pressure and a least restricted section and downstream portion (10) having a section of intermediate restriction, whereby gas exits from the burner along the longitudinal dimensions of said burner head in a substantially laminar form uniformly and the flame is silent.

2. The gas burner according to claim 1 wherein the upper part of the burner body comprises smooth parallel walls defining said different exit sections.

3. The burner according to claim 1 wherein at the top of the two half-shells of the burner body, a plurality of holes (15) are provided to feed a pilot flame.

4. The gas burner according to claim 1 wherein said outlet holes (17) are accompanied by holes (14) for the pilot flame to ensure the stability of the flame.

5. The gas burner according to claim 1 wherein said two half-shells (2) and (3) have inner flanks and two projections (19) are located therein reciprocally facing each other and maintaining constant the distance between said two half-shells.

6. The device according to claim 5 which comprises indentations (20) with holes (15'), said indentations being located on said inner flanks of said half-shells.

* * * * *